US009745089B2

(12) United States Patent
Field et al.

(10) Patent No.: US 9,745,089 B2
(45) Date of Patent: Aug. 29, 2017

(54) PALLETIZED LOAD WRAPPING AND TRANSPORTING VEHICLE AND METHOD

(71) Applicant: The Raymond Corporation, Greene, NY (US)

(72) Inventors: Michael G. Field, Lansing, NY (US); Steve Medwin, Binghamton, NY (US); John Bryant Kirk, Greene, NY (US)

(73) Assignee: THE RAYMOND CORPORATION, Greene, NY (US)

( * ) Notice: Subject to any disclaimer, the term of this patent is extended or adjusted under 35 U.S.C. 154(b) by 0 days.

(21) Appl. No.: 15/468,791

(22) Filed: Mar. 24, 2017

(65) Prior Publication Data

US 2017/0197742 A1 Jul. 13, 2017

Related U.S. Application Data

(62) Division of application No. 13/727,307, filed on Dec. 26, 2012, now Pat. No. 9,637,255.

(51) Int. Cl.
*B65B 11/04* (2006.01)
*B65B 11/02* (2006.01)

(52) U.S. Cl.
CPC ..... *B65B 11/025* (2013.01); *B65B 11/02* (2013.01); *B65B 2210/18* (2013.01)

(58) Field of Classification Search
None
See application file for complete search history.

(56) References Cited

U.S. PATENT DOCUMENTS

| | | | | |
|---|---|---|---|---|
| 4,282,700 | A * | 8/1981 | Goldstein | B65B 11/025 53/556 |
| 5,740,662 | A * | 4/1998 | Royneberg | A01F 15/071 53/211 |
| 8,028,499 | B2 * | 10/2011 | Viaud | A01F 15/071 100/4 |
| 2004/0240975 | A1 * | 12/2004 | Baraggioli | B65B 11/025 414/495 |
| 2012/0311970 | A1 * | 12/2012 | Reijersen Van Buuren | A01D 87/122 53/461 |

FOREIGN PATENT DOCUMENTS

| | | | | |
|---|---|---|---|---|
| ES | EP 2256081 | A1 * | 12/2010 | B62B 3/0612 |
| FR | 2942776 | A1 * | 9/2010 | B65B 11/025 |
| IT | EP 2468635 | A1 * | 6/2012 | B65B 11/025 |

* cited by examiner

*Primary Examiner* — Hemant M Desai
*Assistant Examiner* — Tanzim Imam
(74) *Attorney, Agent, or Firm* — Quarles & Brady LLP

(57) ABSTRACT

A load wrapping and transporting vehicle includes a vehicle frame, and a load support is connected to the vehicle frame for supporting a palletized load. An endless track is connected to the vehicle frame and extends about the load support. A spindle supports a roll of wrapping film and is guided by the endless track about the load support to wrap the palletized load with wrapping film dispensed by the roll of wrapping film.

6 Claims, 5 Drawing Sheets

PALLETIZED LOAD WRAPPING AND TRANSPORTING VEHICLE AND METHOD

CROSS-REFERENCE TO RELATED APPLICATIONS

The present application is a divisional of co-pending U.S. patent application Ser. No. 13/727,307, filed on Dec. 26, 2012, and entitled "Palletized Load Wrapping and Transporting Vehicle and Method," which is hereby incorporated herein by reference in its entirety.

STATEMENT REGARDING FEDERALLY SPONSORED RESEARCH OR DEVELOPMENT

Not applicable.

FIELD OF THE INVENTION

The present invention generally relates to material handling vehicles, and more particularly, palletized load wrapping and transporting vehicles and associated methods.

BACKGROUND OF THE INVENTION

In warehouses and other similar settings, separate mechanisms typically transport and apply "stretch" wrapping film to palletized loads. In particular, pallet trucks or jacks (such as electrically powered or manually displaced autonomous and/or manually-controlled vehicles) typically transport palletized loads. In contrast, fixed-location wrapping stations typically wrap palletized loads. In some cases, wrapping stations rotate the palletized load as wrapping film is dispensed from a roll supported by a vertically movable spindle.

Upon delivering a load to a wrapping station, a palletized load transporting vehicle and, for manually-controlled vehicles, the vehicle's operator remain idle while the load is wrapped. Thus, the processing and labor costs associated with these wrapping operations are relatively high compared to operations that continuously utilize the vehicle and, for manually-controlled vehicles, the vehicle's operator. This issue is exacerbated if a palletized load is wrapped on multiple occasions when assembling "partial" loads (for example, to facilitate load stability and/or to compartmentalize sections of the load).

In an attempt to address the above issues, some palletized load transporting vehicles include wrapping mechanisms. Thus, the vehicle may simultaneously wrap and transport a palletized load. Some previous load wrapping and transporting vehicles include an arm that rotates about a pivot point disposed above the load and thereby defines a circular path about the load. At the opposite end, the arm connects to a vertically extending mast that supports a vertically movable film roll. The roll unwinds and dispenses film to wrap the palletized load as the roll follows the circular path and moves vertically along the mast.

Unfortunately, these vehicles are typically prohibitively large and difficult to maneuver. In particular, to provide sufficient clearance between the film roll and the load, the rotating arm is typically relatively long (for example, several feet or more). As such, the circular path defined by the rotating arm is significantly larger than the width of the vehicle. Thus, these vehicles can only wrap palletized loads in relatively open areas. Similarly, the load supports or "forks" of these vehicles are relatively long (for example, up to 75 percent longer than those of other vehicles). This permits the load to be spaced from other structures of the vehicle so that the vertical mast can pass therebetween. However, relatively long forks increase the turning radius of a vehicle, thereby limiting its maneuverability.

Considering the above, it would be desirable to have palletized load wrapping and transporting vehicles and methods that address one or more of the shortcomings of previous designs.

SUMMARY OF THE INVENTION

In one aspect, the present invention provides a load wrapping and transporting vehicle. The vehicle includes a vehicle frame, and a load support is connected to the vehicle frame for supporting a palletized load. An endless track is connected to the vehicle frame and extends about the load support. A spindle supports a roll of wrapping film and is guided by the endless track about the load support to wrap the palletized load with wrapping film dispensed by the roll of wrapping film.

In another aspect, the present invention provides a load wrapping and transporting vehicle. The vehicle includes a vehicle frame, and a load support is connected to the vehicle frame for supporting a palletized load. A wrapping system connects to the vehicle frame and includes a generally rectangular track defining a generally rectangular endless path about the load support. The wrapping system further includes a carrier supported by the generally rectangular track. The carrier is guided along the generally rectangular endless path about the load support, and the carrier defines a linear path. A spindle is rotatably supported by the carrier and guided along the linear path, and the spindle supports a roll of wrapping film. The spindle and the roll of wrapping film are guided along a generally rectangular helical path to wrap the palletized load with film dispensed by the roll of wrapping film as the carrier is guided along the generally rectangular endless path and the spindle is guided along the linear path relative to the carrier.

In yet another aspect, the present invention provides a method for wrapping a palletized load. The method includes engaging the palletized load using a material handling vehicle having a wrapping system. The wrapping system has a spindle for guiding a roll of wrapping film along a wrapping path about the palletized load. The palletized load is transported toward a receiving location using the material handling vehicle. A motion parameter of the material handling vehicle is determined while transporting the palletized load. The spindle is displaced to guide the roll of wrapping film along the wrapping path and wrap the palletized load with film dispensed by the roll of wrapping film while transporting the palletized load if the motion parameter is within a predetermined range, and the spindle is inhibited from guiding the roll of wrapping film along the wrapping path and wrapping the palletized load while transporting the palletized load if the motion parameter is not within the predetermined range.

The foregoing and advantages of the invention will appear from the following description. In the description, reference is made to the accompanying drawings which form a part hereof, and in which there is shown by way of illustration preferred embodiments of the invention. Such embodiments do not necessarily represent the full scope of the invention, however, and reference is made therefore to the claims herein for interpreting the scope of the invention.

BRIEF DESCRIPTION OF THE DRAWINGS

The invention will hereafter be described with reference to the accompanying drawings, wherein like reference numerals denote like elements, and.

DETAILED DESCRIPTION OF THE PREFERRED EMBODIMENT

Figure 1:
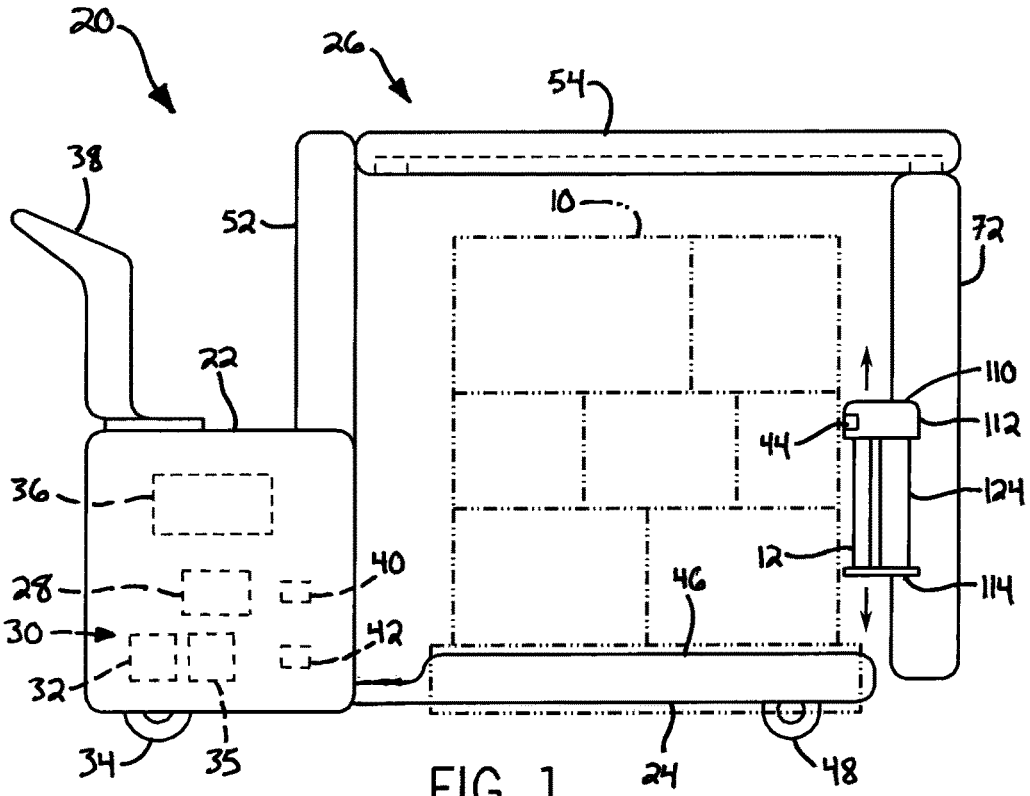
FIG. 1 is a side view of a palletized load wrapping and transporting vehicle according to the present invention.
Figure 2:
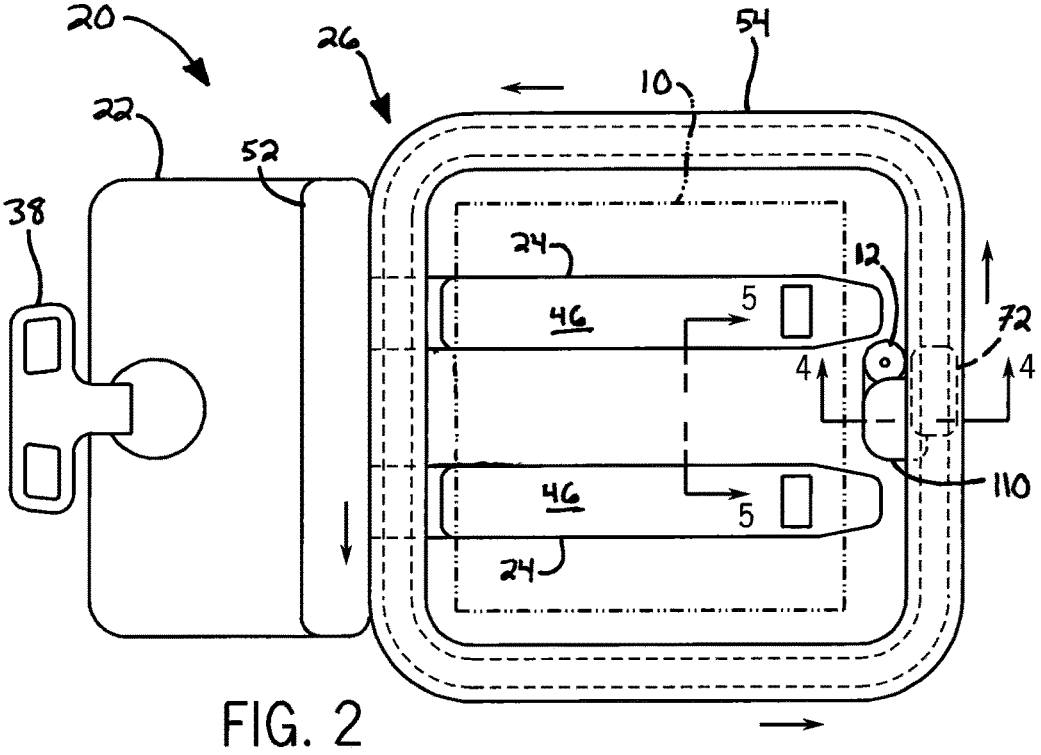
FIG. 2 is a top view of the palletized load wrapping and transporting vehicle of FIG. 1.

Referring now to the figures and specifically FIGS. 1 and 2, the present invention provides, in one aspect, an autonomous and/or manually-controlled palletized load wrapping and transporting vehicle 20. The vehicle 20 generally includes a vehicle body or frame 22 that connects to one or more palletized load supports or "forks" 24. The vehicle frame 22 also supports a palletized load wrapping system 26 that is generally disposed above the load supports 24. The wrapping system 26 wraps a palletized load 10 with wrapping film dispensed from a roll 12 as the vehicle 20 transports the load 10 to a receiving location (such as a shipping vehicle, a container, a temporary storage structure, or the like). Thus, the vehicle 20 reduces or eliminates the idle time associated with previous palletized load transporting vehicle and wrapping systems. Furthermore, the wrapping system 26 is advantageously structured to permit wrapping operations in confined areas and facilitate vehicle maneuverability. The above vehicle components, their advantages, and their interactions with the palletized load 10 are described in further detail below.

Figure 6:
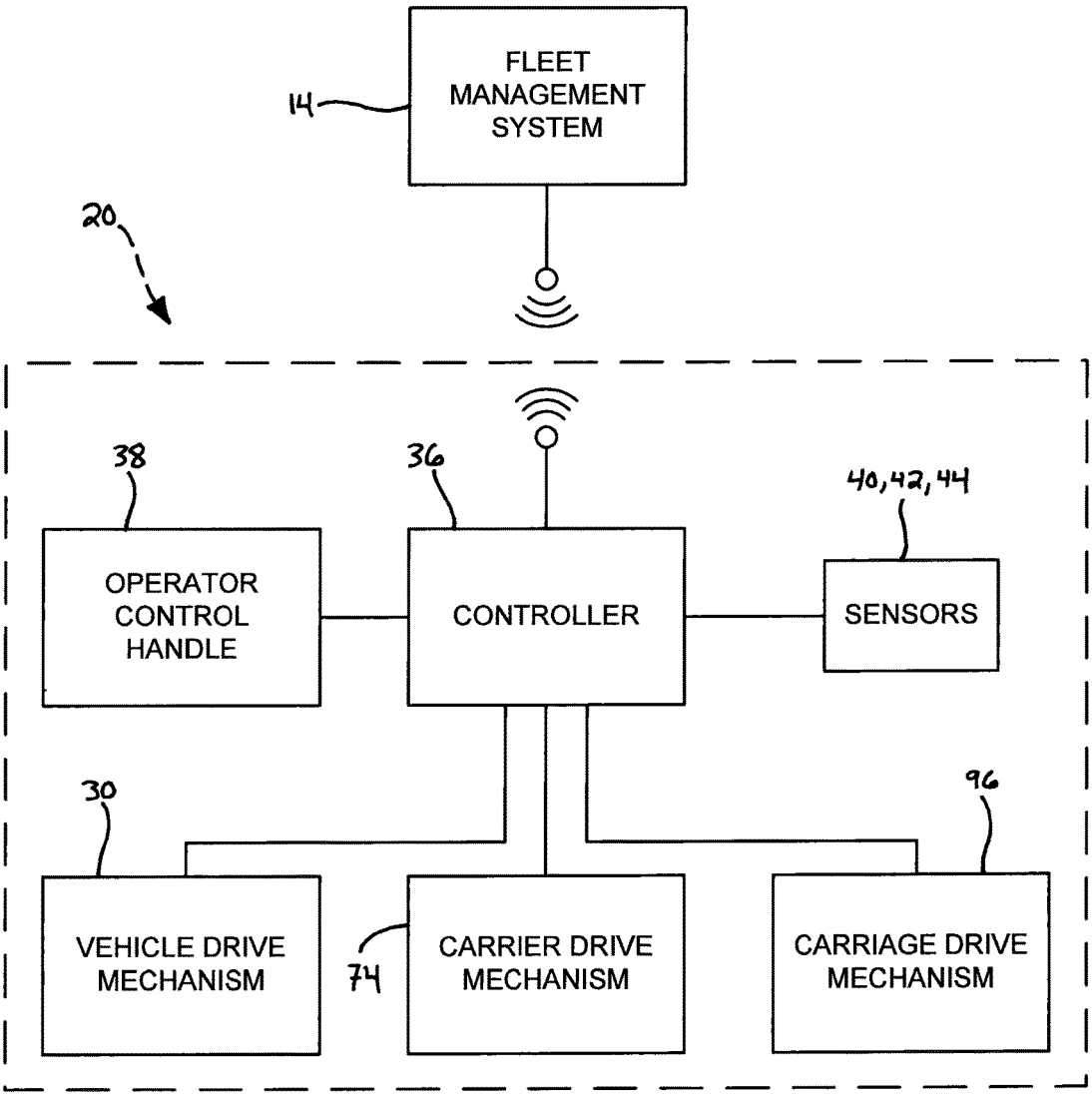
FIG. 6 is a simplified schematic of electronic components of the vehicle of FIG. 1.

Referring to FIGS. 1, 2, and 6, the vehicle frame 22 houses and supports various vehicle components and subsystems. In particular, the frame 22 houses a power source 28 (such as a rechargeable battery or the like) that delivers power to, among other components, a vehicle drive mechanism 30. The drive mechanism 30 includes a first prime mover 32 (such as an electric motor or the like) that rotates one or more drive wheels 34 to propel the vehicle 20 along a surface. The drive mechanism 30 also includes a second prime mover 35 (such as another electronic motor or the like) that pivots the drive wheels 34 to steer the vehicle 20.

The vehicle frame 22 also houses an electronic controller 36 (such as a programmable logic controller or the like) that operatively connects to and controls various components of the vehicle 20. The controller 36 operates in different manners if the vehicle is autonomous or manually-controlled. For example, if the vehicle 20 is autonomous, the controller 36 may receive wireless commands for controlling the drive mechanism 30 and the wrapping system 26. Such commands may be transmitted by a management system 14 (FIG. 6) that coordinates and monitors operations of a fleet of vehicles 20. If the vehicle 20 is manually-controlled, the controller 36 may receive command signals from depressible buttons and switches supported by the vehicle frame 22 and/or an operator control handle 38.

The controller 36 receives signals from one or more sensors 40, 42 (such as position sensors, speed sensors, acceleration sensors, load sensors, vehicle proximity sensors, or the like) supported by the vehicle frame 22. The controller 36 may inhibit operation of the wrapping system 26 based on signals received from the sensors 40, 42 as described in further detail below. The controller 36 also receives signals from one or more sensors 44 supported by the wrapping system 26. These sensors 44 facilitate determining characteristics of the palletized load 10. For example, the sensors 44 may be optical sensors for determining the dimensions of the palletized load 10 and the load's position on the forks 24. The sensors 44 may additionally act as proximity sensors to detect the presence and the approach of other objects toward the vehicle 20 and/or the load 10. Operations of the controller 36, the sensors 40, 42, 44, and the wrapping system 26 are described in further detail below in connection to FIG. 7.

Referring to FIGS. 1 and 2, the load supports 24, as the name implies, supports the load 10 while the vehicle 20 travels. The load supports 24 are generally elongated components that are spaced apart in a horizontal direction. Each load support 24 includes an upper surface 46 for supporting the palletized load 10. Opposite the upper surface 46, each load support 24 rotatably mounts one or more non-driven wheels 48. The load supports 24 are displaced vertically (for example, to engage or disengage the palletized load 10) by an elevating mechanism (such as a hydraulic actuator or the like; not shown) operatively connected to the controller 36.

Turning now to FIGS. 1-5, the wrapping system 26 wraps the palletized load 10 while the vehicle 20 transports the load 10 toward the receiving location. The wrapping system 26 includes a support mast 52 that extends vertically from the vehicle frame 22. The support mast 52 acts as support structure for other components of the wrapping system 26, which are cantilevered near the upper end of the support mast 52. Thus, the support mast 52 may be formed by multiple high-strength brackets (comprising steel or the like; not shown). The support mast 52 and the other components of the wrapping system 26 may be displaced vertically by the elevating mechanism connected to the load supports 24 or another elevating mechanism (such as another hydraulic actuator or the like; not shown) independent of the load supports 24.

At its upper end, the support mast 52 connects to an endless track 54 that defines, in part, a wrapping path about the load supports 24 and the palletized load 10. The endless track 54 has a generally rectangular shape as viewed from above (that is, as shown in FIG. 2). As used herein, the term "generally rectangular" and variations thereof include traditional rectangles (that is, rectangles having parallel sides and sharp corners), rectangles with rounded corners (as shown in the figures), and/or shapes having four sides in which opposite sides are substantially parallel (that is, parallel within +/−5 degrees). Advantageously, the generally rectangular track 54 allows the vehicle 20 to operate in relatively confined areas, such as narrow aisles, compared to the vehicles described above.

Figure 3:
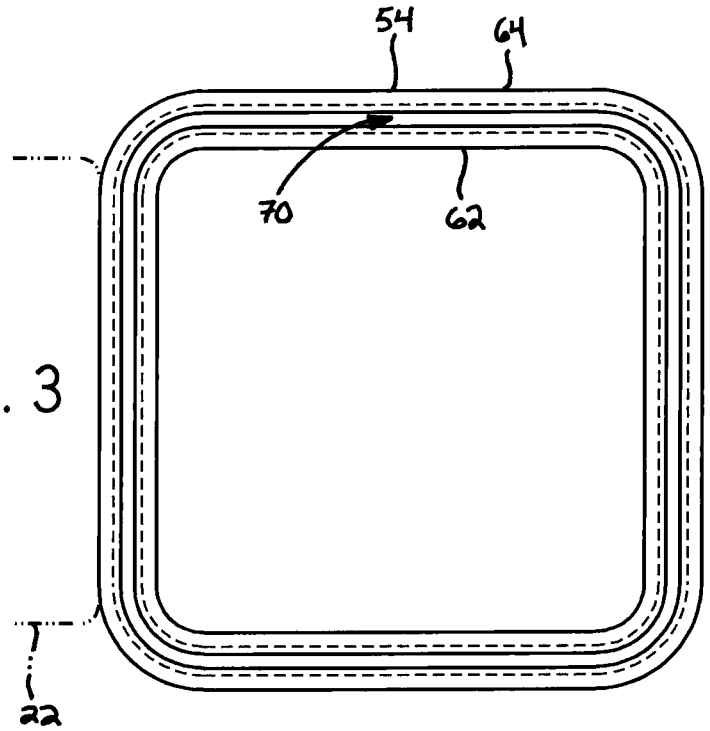
FIG. 3 is a bottom view of an endless track of a wrapping system of the vehicle of FIG. 1.
Figure 4:
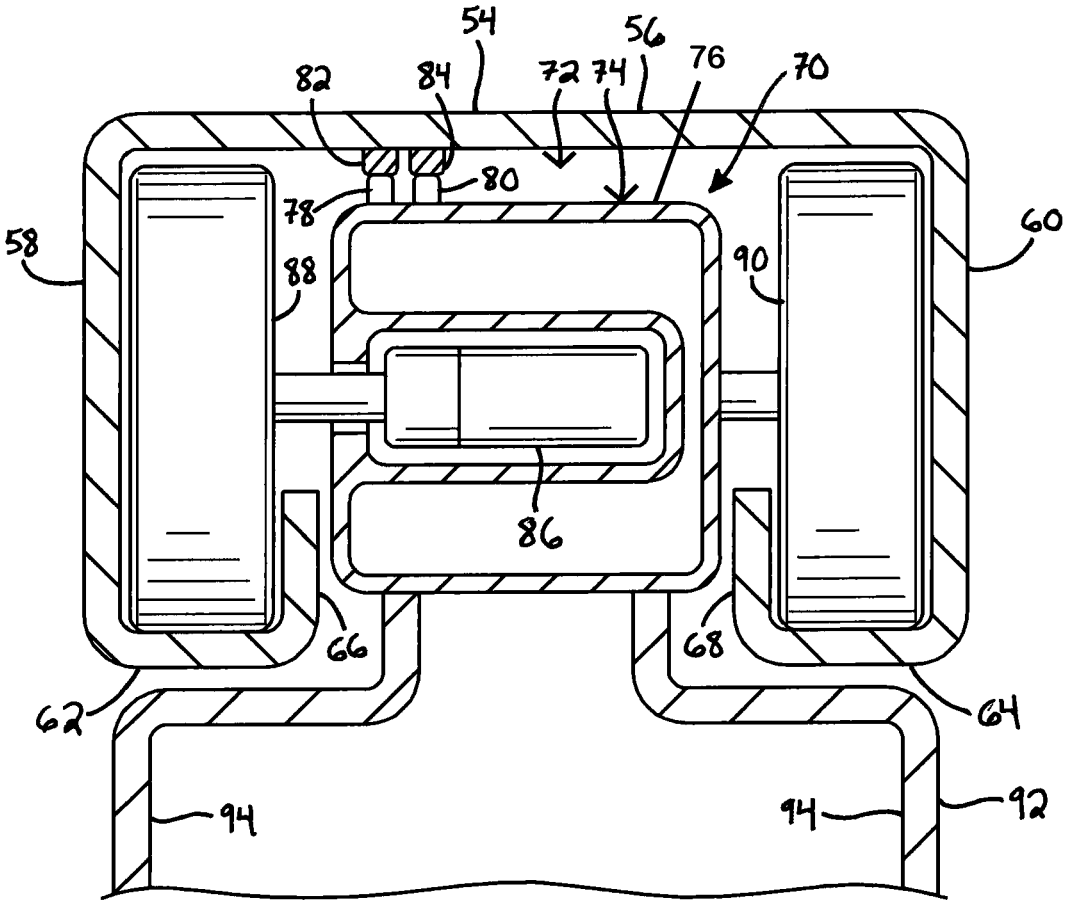
FIG. 4 is a section view of the wrapping system of the vehicle along line 4-4 of FIG. 2.
Figure 5:
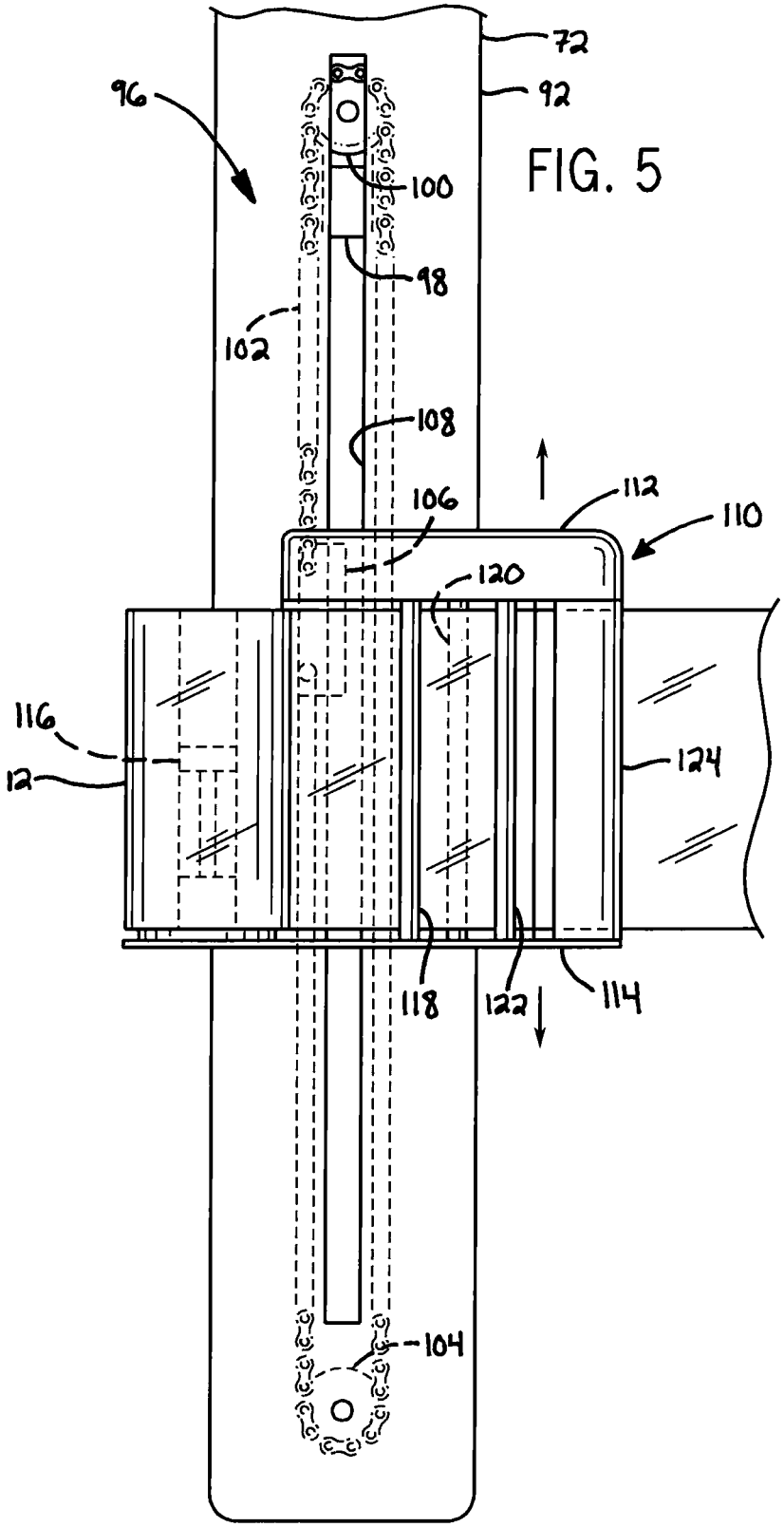
FIG. 5 is a side view of a carrier and a carriage of the wrapping system along line 5-5 of FIG. 2.

Referring specifically to FIGS. 3 and 4, the endless track 54 also includes a plurality of walls that may each be formed by a relatively high-strength material (such as steel or the like). The walls include a top wall 56, and side walls 58 and 60 extend downwardly from edges of the top wall 56. Lower walls 62 and 64 extend inwardly from edges of the side walls 58 and 60, respectively. Spaced-apart inner walls 66 and 68 extend upwardly from edges of the lower walls 62 and 64, respectively. Together the walls 56-68 define an internal passageway 70, and the internal passageway 70 partially receives a translatable carrier 72 that moves along the track 54 about the palletized load 10.

The carrier 72 includes various components that facilitate moving the roll 12 about the palletized load 10. In particular, the carrier 72 includes a drive mechanism 74 that is housed within the internal passageway 70 of the track 54. The drive mechanism 74 includes a housing 76 that may comprise various materials, such as steel or the like. The housing 76 supports external electrical contacts 78 and 80. The electrical contacts 78 and 80 engage additional electrical contacts 82 and 84, respectively, that extend about the internal passageway 70. Thus, the electrical contacts 78-84 provide electrical power to a prime mover 86 (such as an electric motor or the like) mounted within the housing 76. The prime mover 86 drives wheels 88 and 90 supported by the lower walls 62 and 64, respectively, of the track 54. As such, the drive mechanism 74 moves along an endless and horizontally-disposed portion of the wrapping path defined by the internal passageway 70 of the track 54.

The drive mechanism 74 connects to a carrier housing 92 between the inner walls 66 and 68 of the track 54. The carrier housing 92 generally extends in a vertical direction and includes walls 94 that may be formed by various materials (such as metals, plastics, or the like). The carrier housing 92 also mounts a drive mechanism 96 that moves the roll 12 in a vertical direction as the carrier 72 moves about the palletized load 10. The drive mechanism 96 includes a prime mover 98 (such as another electric motor or the like) that receives electrical power from the upper drive mechanism 74. The prime mover 98 drives an upper sprocket 100, and the upper sprocket 100 in turn drives an chain 102. The chain 102 is also guided by a lower sprocket 104 disposed near the bottom of the carrier housing 92. The chain 102 fixedly connects to a support bracket 106. The support bracket 106 extends through a vertically extending slot 108 formed in the carrier housing 92 and connects to a film dispensing carriage 110. That is, the carrier 72 defines a vertically extending linear path along which the carriage 110 and the roll 12 move relative to the carrier 72.

The carriage 110 includes an upper bracket 112 and a lower bracket 114 (such as steel brackets or the like) for supporting various components that facilitate dispensing film from the roll 12. The lower bracket 114 mounts a rotatable spindle 116 that supports the roll 12. The brackets 112 and 114 also mount guide rollers 118, 120, and 122 that engage film dispensed from the roll 12. The film is also guided through a tension-based film "cutter" 124 before being directed toward the palletized load 10.

Thus, the drive mechanisms 74 and 96 are energized simultaneously to move the carriage 110 and the roll 12 along a rectangular endless path as viewed from above (that is, in a horizontal plane) and along a linear path relative to the carrier 72 (that is, in a vertical plane). By moving along these two paths simultaneously, the carriage 110 and the roll 12 move along a wrapping path that has a generally rectangular "helical" shape. Such a shape is similar to a circular helical shape, although it appears to be generally rectangular instead of circular when viewed along its helix axis (that is, as viewed from above).

Figure 7:
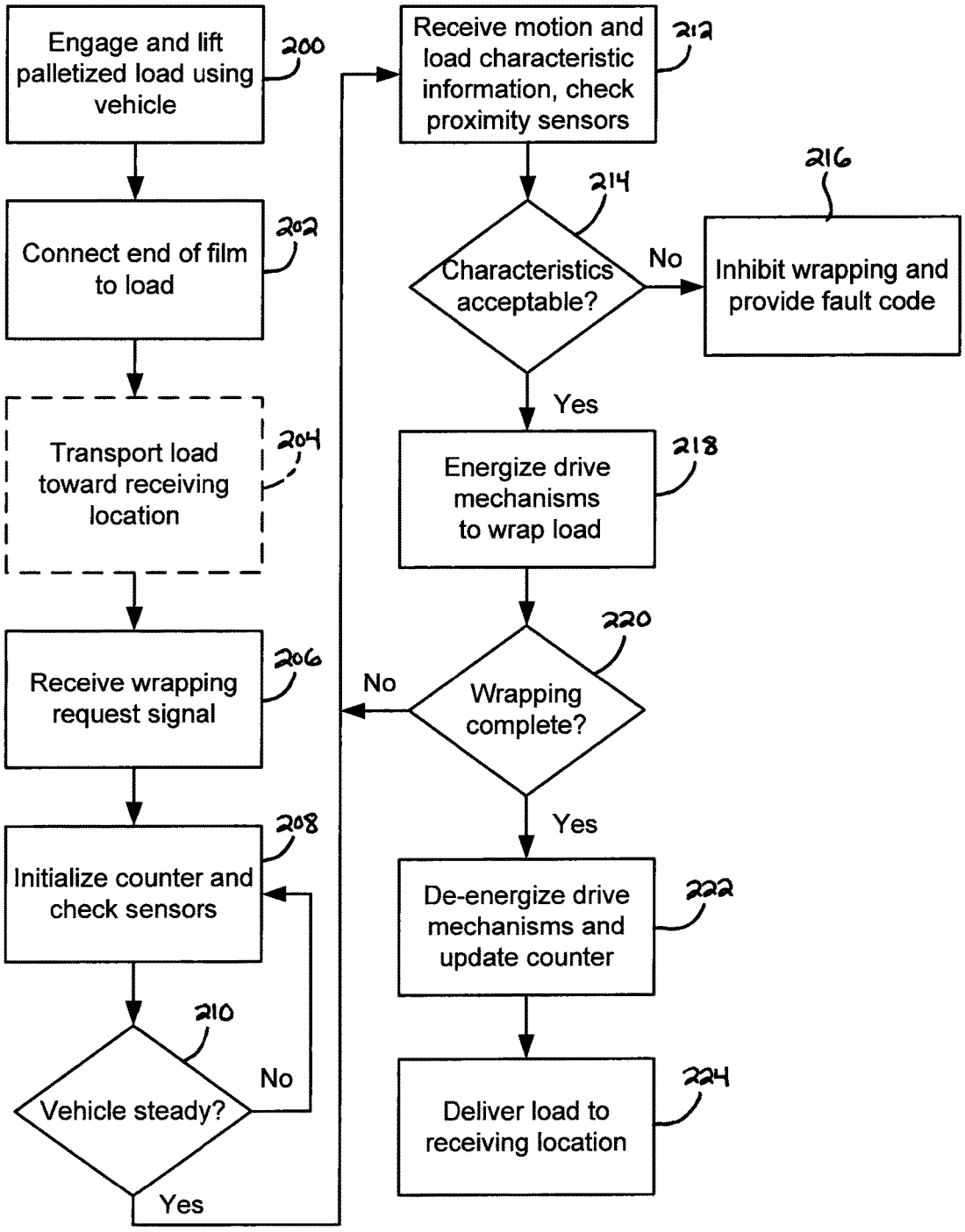
FIG. 7 is a flow chart of a method for controlling a palletized load wrapping and transporting vehicle according to the present invention.

The drive mechanisms 74 and 96 may also be energized while the vehicle drive mechanism 30 is energized (that is, while the vehicle 20 travels). However, the present invention also provides a method for controlling operation of the wrapping system 26 in response to a motion parameter of the vehicle 20, such as a rate of change of the steering angle. Turning now to FIG. 7, such a method begins at process block 200 by engaging and lifting the palletized load 10 using the vehicle 20. Next, the end of the wrapping film from the roll 12 is connected to the palletized load 10 at process block 202 (for example, by manually adhering to the film to the load 10 or the like). The vehicle 20 may transport the load 10 towards the receiving location at process block 204. However, the subsequent actions can also be performed if the vehicle 20 is stationary (for example, in situations in which the load 10 is only transported a short distance).

At process block 206, the controller 36 receives a wrapping request signal (from the fleet management system 14, from the operator control handle 38, or the like). At process block 208, the controller 36 initializes a pallet wrapping counter (such as an electronic counter maintained by the controller 36) and checks operation of the sensors 40, 42, and 44. The controller 36 then determines if the vehicle's motion is steady by analyzing a motion parameter at decision block 210. The motion parameter may be, for example, a rate of change of the vehicle's steering angle determined based on signals received from a steering angle sensor 42 (such as a Hall effect sensor coupled to the steering motor 35 or the like). If the motion parameter is outside of a predetermined range (for example, differing from zero radians/sec+/−0.2 radians/sec), the method returns to process block 208 to avoid load shifting while wrapping. If the motion parameter is within the predetermined range, the method continues to process block 212.

At process block 212, the controller 36 receives information regarding the vehicle's motion and characteristics of the palletized load 10. In particular, the controller 36 determines the amount of film on the roll 12 (via an optical sensor, a load sensor, or the like), acceleration of the vehicle (via the acceleration sensor 40 or the like), and the palletized load's dimensions (via the optical sensor 44 or the like). At decision block 214, the controller 36 determines if the above characteristics are within acceptable ranges to perform a wrapping operation. Specifically, the controller 36 determines if the roll 12 has sufficient film to wrap the load 10, if the vehicle 20 is accelerating in an acceptable manner, if the proximity sensors 44 do not detect nearby or approaching objects, and if the load 10 is sized and located on the loads supports 24 such that the wrapping system 26 will not strike the load 10 during a wrapping operation. If any of these characteristics are outside of an acceptable range, the method proceeds to process block 216. At process block 216, the controller 36 provides a fault code to identify the characteristic that is outside of an acceptable range. The controller 36 also inhibits operation of the wrapping system 26 (that is, the controller 36 does not energize the wrapping drive mechanisms 74 and 96). However, the vehicle 20 may continue to transport the load 10 toward the receiving location. In contrast, if the above characteristics are all within the acceptable ranges, the method proceeds to process block 218. At process block 218, the controller 36 energizes the drive mechanisms 74 and 96 to wrap the load 10 with film dispensed by the roll 12.

Next, the controller 36 determines if the wrapping operation is complete at decision block 220. This may be achieved via the optical sensor 44, by recognizing that the carriage 110 has traversed the length of the carrier housing 92, or the like. If the wrapping operation is not complete, the method returns to process block 212. If the wrapping operation is complete, the method proceeds to process block 222 and de-energizes the drive mechanisms 74 and 96. The controller 36 also updates the wrapping counter, and the updated count may be transmitted to the fleet management system 14. At process block 224, the method concludes by delivering the palletized load 10 to the receiving location.

The vehicle 20 and method can be modified in various other manners that are not explicitly described above. For example, the drive mechanisms 30, 74, and 96 could be omitted and replace by components facilitating manual displacement of the vehicle 20 and the wrapping system 26. As another example, the steering motor 35 could be omitted and the control handle 38 could directly steer the vehicle 20. As yet another example, the carrier 72 and the carriage 110 could take different forms or include different components. The carriage 110 could include, for example, additional components for applying labels and indicia to a wrapped palletized load.

From the above, it should be apparent that the palletized load wrapping and transporting vehicles and methods according to the present invention provide significant advantages over previous designs. In particular, the endless track 54 defines a relatively compact wrapping path relative to the overall dimensions of the vehicle 20. Thus and unlike previous designs, the vehicle 20 can wrap palletized loads in confined areas. Similarly, the forks 24 are relatively short because little space is needed between the vehicle frame 22 and the load 10 to permit the carrier 72 to pass therebetween. Thus, the vehicle 20 is relatively maneuverable compared to previous designs.

It is specifically intended that the present invention not be limited to the embodiments and illustrations contained herein, but include modified forms of those embodiments including portions of the embodiments and combinations of elements of different embodiments as defined within the scope of the following claims.

What is claimed is:

1. A method for wrapping a palletized load, comprising the steps of:

engaging said palletized load using a material handling vehicle having a wrapping system, said wrapping system having a spindle for guiding a roll of wrapping film along a wrapping path about said palletized load;

transporting said palletized load toward a receiving location using said material handling vehicle;

determining a motion parameter of said material handling vehicle while transporting said palletized load; and displacing said spindle to guide said roll of wrapping film along said wrapping path and wrap said palletized load with film dispensed by said roll of wrapping film while transporting said palletized load if said motion parameter is within a predetermined range, and inhibiting said spindle from guiding said roll of wrapping film along said wrapping path and wrapping said palletized load while transporting said palletized load if said motion parameter is not within said predetermined range.

2. The method of claim 1, further comprising the step of receiving a wrapping request signal at said material handling vehicle while transporting said palletized load, and the step of determining said motion parameter includes determining said motion parameter in response to receiving said wrapping request signal.

3. The method of claim 2, wherein said motion parameter is a steering parameter of said material handling vehicle.

4. The method of claim 3, wherein said steering parameter is a rate of change of a steering angle of said material handling vehicle.

5. The method of claim 1, wherein said wrapping system includes a track defining an endless path and a carrier guided by said track along said endless path, said carrier guiding said spindle along a linear path relative to said carrier, and wherein the step of displacing said spindle to guide said roll of wrapping film along said wrapping path includes guiding said carrier along said endless path and guiding said spindle along said linear path relative to said carrier.

6. The method of claim 5, wherein said endless path is a generally rectangular endless path.

* * * * *